United States Patent [19]

Moell

[11] Patent Number: 4,832,391

[45] Date of Patent: May 23, 1989

[54] DRUM HANDLING SLING

[76] Inventor: Frank G. Moell, 1040 Bennett, Carson City, Nev. 89702

[21] Appl. No.: 189,543

[22] Filed: May 3, 1988

[51] Int. Cl.[4] ..... B66C 1/14

[52] U.S. Cl. ..... 294/82.13; 294/74; 294/90

[58] Field of Search ..... 294/4, 74, 79, 82.1, 294/82.11-82.13, 86.41, 90; 59/93

[56] References Cited

U.S. PATENT DOCUMENTS

| | | | |
|---|---|---|---|
| 62,489 | 2/1867 | Hopkins | 294/82.13 |
| 1,451,657 | 4/1923 | Hefner | 294/82.13 |
| 2,555,430 | 6/1951 | Weeks | 294/82.13 X |
| 2,573,216 | 10/1951 | Natoli | 294/82.13 |
| 2,832,628 | 4/1958 | Turnbull | 294/82.11 X |
| 3,488,079 | 1/1970 | Stinchfield | 294/82.13 |
| 4,359,241 | 11/1982 | Kistner | 294/82.13 |

*Primary Examiner*—Johnny D. Cherry

*Attorney, Agent, or Firm*—Fleit, Jacobson, Cohn & Price

[57] ABSTRACT

An elongated link chain assembly is provided including opposite end hooks opening toward each other and an intermediate length hook adjacent one of the opposite end hooks but opening toward the other end hook. The hooks include hook ends adapted to radially or axially engage the circumferential diametrically enlarged beads at the opposite ends of a metal drum or barrel. The link chain assembly may be engaged intermediate its opposite ends by a link chain hook supported from a lifting chain.

11 Claims, 1 Drawing Sheet

FIG. 1
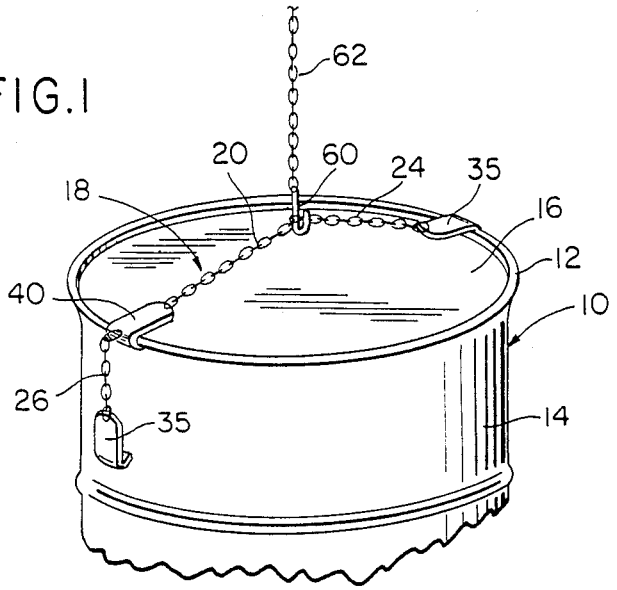
FIG. 2
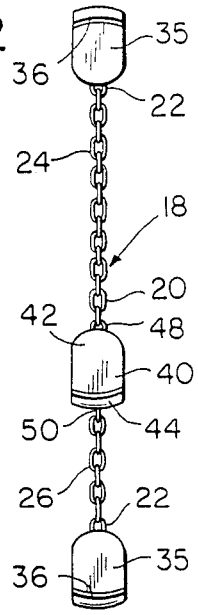
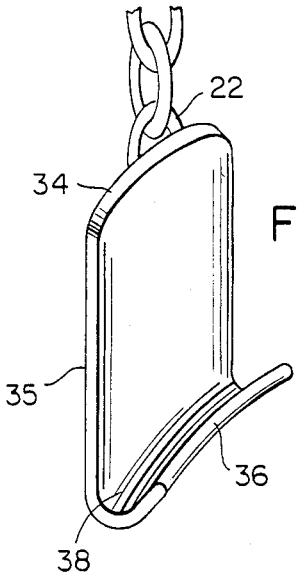
FIG. 3
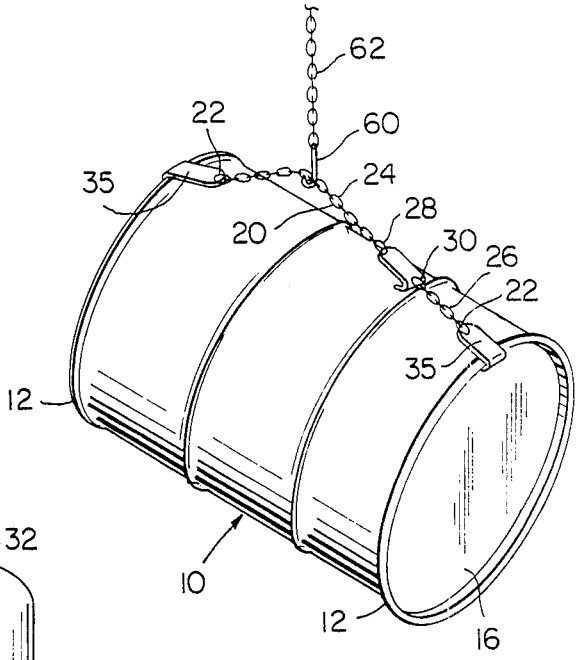
FIG. 5
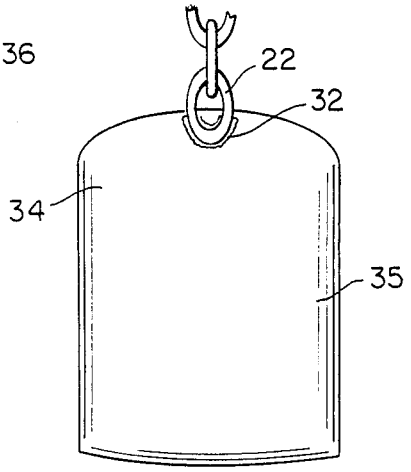
FIG. 4

DRUM HANDLING SLING

BACKGROUND OF THE INVENTION

1. Field of the Invention

It is often necessary, during loading and unloading operations, to lift 55 gallon drums and similar drums of different capacity. In some instances, such drums may be vertically disposed and in other instances they may be horizontally disposed. The instant invention resides in the provision of a sling constructed in a manner such that it may be used, in conjunction with a lift chain or cable, for engaging and lifting either a vertically disposed drum or a horizontally disposed drum.

2. Description of Related Art

Various different drum slings and other devices including some of the general structural and operational features of the instant invention are disclosed in U.S. Pat. Nos. 62,489, 2,555,430, 3,488,079 and 4,359,241. U.S. Pat. No. 62,489 to T. Hopkins discloses a drum sling which is probably most pertinent of these prior art references to the structural and operational features of the instant invention. However, the sling of the instant invention includes a combination of structural and operational features not disclosed by the above noted prior U.S. patents.

SUMMARY OF THE INVENTION

The drum sling of the instant invention incorporates a single length tension member construction including strap-type opposite end hooks which open toward each other and a mid-portion strap-type hook adjacent one of the opposite end hooks but which opens toward the other opposite end hook. By providing a single length tension member structure such as that which may be defined by interconnected chain links and incorporating the aforementioned three strap-type hooks, a sling is provided which may be selectively engaged with a horizontally disposed drum or a vertically disposed drum and, when used in conjunction with a link chain engaging lifting hook may be used to lower a drum supported therefrom in a selected inclined position, if desired.

The main object of this invention is to provide a drum sling operable to engage and lift a cylindrical drum for lifting the latter, whether the drum is vertically disposed or horizontally disposed.

Another object of this invention is to provide a drum sling which may be specifically constructed for use in conjunction with relatively large drums such as 55 gallon drums, but which includes structural and operational features which enable the same size sling to be used in conjunction with smaller drums such as 30 gallon drums.

Still another important object of this invention is to provide a drum sling constructed in a manner such that it may be readily operatively engaged with a drum to be lifted by even inexperienced persons.

A further object of this invention is to provide a drum sling which may be readily operatively engaged with a drum to be lifted by a single workperson.

A final object of this invention to be specifically enumerated herein is to provide a drum sling in accordance with the preceding objects and which will conform to conventional forms of manufacture, be of simple construction and easy to use so as to provide a device that will be economically feasible, long-lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a fragmentary perspective view of the upper end portion of a typical 55 gallon drum and with the drum sling of the instant invention operatively associated with the drum upper end for lifting the latter in conjunction with a lift chain and hook.

FIG. 2 is a plan view of the drum sling as seen from the underside thereof.

FIG. 3 is an enlarged perspective view of one end portion of the drum sling illustrating the shape configuration of a typical strap-type hook member of the sling.

FIG. 4 is an elevational view of the structure illustrated in FIG. 3 as seen from the left side thereof.

FIG. 5 is a perspective view of a typical 55 gallon drum in a generally horizontal position supported from a lift chain and hook through utilization of the drum sling of the instant invention.

DESCRIPTION OF THE PREFERRED EMBODIMENT

Referring now more specifically to the drawings, the numeral 10 generally designates a conventional form of 55 gallon drum. The drum 10 is generally cylindrical and includes opposite end diametrically enlarged circumferentially extending beads 12 by which the axial ends of the body 14 of the drum 10 are joined to the axial end walls 16 of the drum 10, the end walls 16 being slightly recessed within the opposite axial ends of the body 14.

The foregoing comprises a description of a typical form of 55 gallon drum.

The numeral 18 generally refers to a drum sling constructed in accordance with the present invention. The sling 18 includes an elongated link chain assembly 20 having opposite end links 22. The link chain assembly 20 incorporates a pair of long and short link chain sections 24 and 26 disposed in end aligned relation and including adjacent end links 28 and 30 interconnected in a manner to be hereinafter more fully set forth and remote end links comprising the end links 22. Each end link 22 is secured in any convenient manner such as by welding 32 to the base end 34 of an elongated strap-type hook member 35, each hook member 35 including a reversely turned hook end 36 on its end thereof remote from the base end 34. The hook members 35 are slightly transversely arcuate and open outwardly of the sides thereof to which the hook ends 36 are directed and the hook ends 36 define channels 38 which open toward the corresponding base ends 34 and are longitudinally curved to be slightly concave in the directions in which the channels 38 open (toward the base ends 34). In addition, the hook ends 36 are transversely arcuate such that their convex sides oppose the concave sides of the hook members 35.

The hook members 35 are thus disposed with their base ends facing toward each other and their hook ends facing away from each other.

A third hook member 40 is provided and includes a base end 42 and a hook end 44, the base and hook ends 42 and 44 corresponding to the base and hook ends 34 and 36. Actually, the hook members 35 and 40 may be identically constructed. The link chain section 24 includes an end link 48 remote from the end link 22 which is secured to the base end 42 of the hook member 40 and the link chain section 26 includes an end link 50 which is secured to the hook end 44 of the hook member 40. Thus, the hook member 40 is interposed in the link chain assembly 20 between the links 48 and 50 thereof. However, if it is desired, the link chain assembly 20 may include additional interconnected links sufficient to span between and interconnected with the links 48 and 50.

Most 55 gallon drums such as the drum 10 are of predetermined axial extent and the distance between the hook ends 36 of the hook members 35 is slightly greater than the axial length of the drum 10. This enables the hook ends 36 of the hook members 35 to be hook engaged over the diametrically enlarged circumferential beads 12 with a minimum amount of slack of the link chain assembly 20 being provided between the hook members 35 after the latter are engaged over the beads 12. Then, a link chain hook 60 carried by the lower end of a lifting chain 62 may be engaged with the link chain assembly 12 at a desired point therealong. If the drum 10 to be lifted is horizontally disposed and the drum 10 is to be maintained in a horizontally disposed condition, the hook 60 is engaged with the link chain assembly closely adjacent the base end 42 of the third hook member 40. The exact mid-point of the distance between the opposite end hook members 35 occurs at a point on the link chain section 24 closely adjacent the base end 42 of the third hook member 40. This enables the drum to be lifted and maintained in a horizontal position while lifted. However, a horizontal drum 10 may be lifted from a horizontal or inclined support surface and maintained in a predetermined position when lifted merely by adjusting the positioning of the hook 60 along the link chain section 24.

If the drum 10 is vertically disposed as illustrated in FIG. 1, only the third hook member 40 and the hook member 35 furtherest from the hookmember 40 are used in the manner illustrated in FIG. 1. If the drum 10 is to be lifted and maintained in a vertical position, the hook 60 may be engaged with the longitudinal mid-portion of the link chain section 24. However, if the drum is to be inclined after being lifted from a vertical surface, the hook 60 may be engaged with the link chain section 24 adjacent either the hook 40 or the hook 35 furtherest from the hook 40.

Inasmuch as the hook members 35 are transversely arcuate with their concave sides facing outwardly of the same sides to which the hook ends 36 are directed, the hook members 35 radially conform to the outer peripheral curved surfaces of the beads 12. Further, inasmuch as the hook ends 36 are transversely curved, the inner sides thereof which define the corresponding sides of the channels 38 radially conform to the inner curved peripheral surfaces of the beads 12. Also, inasmuch as the channels 38 are longitudinally curved to be slightly concave in the directions in which the channels 38 open toward the corresponding base ends 34, the channels 38 radially conform to the outer peripheral surfaces of the beads 12 when the drum 10 is being lifted in the manner illustrated in FIG. 1.

Inasmuch as the distance between the hook ends 36 of the hook members 35 is only slightly greater than the length of a conventional 55 gallon drum, the sling 18 also may be used in conjunction with slightly shorter 30 gallon drums of the same general type. Further, inasmuch as the distance between the hook end 44 of the third hook member and the hook end 36 of the hook member 35 to which the end link 22 is secured is only slightly greater than the diameter of the 55 gallon drum, the drum sling 18 also may be used in conjunction with smaller 30 gallon drums when such 30 gallon drums are to be lifted while vertically disposed.

It is also pointed out that the link chain sections 24 and 26 could be replaced by similar length cable sections. However, the use of such cable sections would not enable the link chain hook 60 to be maintained in engagement with a predetermined length portion of such cable sections without sliding therealong. Accordingly, in the preferred form of the drum sling 18 link chain sections such as those illustrated at 24 and 26 are preferred, although a single length link chain section could be used as hereinabove set forth.

The foregoing is considered as illustrative only of the principles of the invention. Further since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A drum handling sling for lifting a cylindrical drum, whether the drum is horizontally or vertically disposed and wherein the drum is of predetermined axial extent and diameter and includes diametrically enlarged circumferential opposite end beads and slightly inwardly recessed opposite end walls, said sling including elongated flexible tension member means having opposite terminal end portions and a mid-portion extending between said terminal end portions, said terminal end portions including a pair of elongated, flat strap-type hook members having opposing base ends anchored relative to said terminal end portions and remote reversely turned hook ends opening toward each other, said hook ends being spaced apart a distance adapted to slightly more than span the distance between said beads, said mid-portion including a third elongated, flat strap-type hook member having opposite base and reversely turned hook ends, said third hook member being anchored relative to said mid-portion adjacent but spaced from one of said pair of hook members with the reversely turned hook end of said third hook member opening toward the other hook member of said pair of hook members, the spacing between the reversely turned hook ends of said other and third hook members being adapted to slightly more than span the diameter of said drum.

2. The drum sling of claim 1 wherein said hook members, from said base ends to the reversely turned hook ends thereof, are slightly transversely arcuate with their concave sides opening toward the sides thereof outwardly of which the corresponding reversely turned hook ends are directed.

3. The drum sling of claim 1 wherein said hook members are at least substantially longitudinally straight between said base and reversely turned hook ends thereof.

4. The drum sling of claim 1 wherein said tension member means includes first and second sections thereof with spaced part adjacent ends, said third hook member having one of said adjacent ends anchored to the base end thereof and the other of said adjacent ends anchored relative to the reversely turned hook end thereof.

5. The drum sling of claim 1 wherein said reversely turned hook ends define channels opening toward the corresponding hook member base ends and said channels are slightly longitudinally curved to be slightly concave in the directions in which said channels open.

6. The drum sling of claim 5 wherein said hook members, from said base ends to the reversely turned hook ends thereof, are slightly transversely arcuate with their concave sides opening toward the sides thereof outwardly of which the corresponding reversely turned hook ends are directed.

7. The drum sling of claim 6 wherein said hook members are at least substantially longitudinally straight between said base and reversely turned hook ends thereof.

8. The drum sling of claim 7 wherein said tension member means includes first and second sections thereof with spaced apart adjacent ends, said third hook member having one of said adjacent ends anchored to the base end thereof and the other of said adjacent ends anchored relative to the reversely turned hook end thereof.

9. The drum sling of claim 1 wherein said tension member means comprises link chain means.

10. In combination with a cylindrical drum of predetermined axial extent and diameter and including diametrically enlarged circumferential opposite axial end beads and slightly inwardly recessed opposite end walls, a drum sling for lifting said drum whether the drum is horizontally or vertically disposed, said sling including elongated flexible tension member means having opposite end portions and a mid-portion extending between terminal end portions, said terminal end portions including a pair of elongated, flat strap-type hook members having opposing base ends anchored relative to said terminal end portions and remote reversely turned hook ends opening toward each other, said hook ends being spaced apart a distance slightly than the axial length of said drum, said mid-portion including a third elongated, flat strap-type hook member including opposite base and remote reversely turned hook ends, said third member being anchored relative to said mid-portion adjacent but spaced from one of said pair of hook members and with the reversely turned hook end thereof opening toward the other hook member of said pair of hook members, the spacing between the reversely turned hook ends of said other and third hook members being slightly greater than the diameter of said drum.

11. The drum and drum sling combination of claim 10 wherein said tension member means comprises link chain means.

* * * * *